US011120936B2

(12) United States Patent
Tsai et al.

(10) Patent No.: US 11,120,936 B2
(45) Date of Patent: Sep. 14, 2021

(54) MAGNETIC COMPONENT MODULE

(71) Applicant: DELTA ELECTRONICS, INC., Taoyuan (TW)

(72) Inventors: Hsin-Wei Tsai, Taoyuan (TW); Hua-Sheng Lin, Taoyuan (TW); Ming-Cheng Lee, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 342 days.

(21) Appl. No.: 16/119,176

(22) Filed: Aug. 31, 2018

(65) Prior Publication Data

US 2020/0027642 A1 Jan. 23, 2020

(30) Foreign Application Priority Data

Jul. 18, 2018 (CN) ..... 201821135597.0

(51) Int. Cl.

| | |
|---|---|
| ***H01F 27/24*** | (2006.01) |
| ***H01F 27/26*** | (2006.01) |
| ***H01F 41/02*** | (2006.01) |
| ***H01F 27/28*** | (2006.01) |
| *H01F 27/38* | (2006.01) |

(52) U.S. Cl.

CPC ..... *H01F 27/26* (2013.01); *H01F 27/24* (2013.01); *H01F 27/2823* (2013.01); *H01F 41/0206* (2013.01); *H01F 27/28* (2013.01); *H01F 27/38* (2013.01)

(58) Field of Classification Search

CPC .. H01F 27/26; H01F 41/0206; H01F 27/2823; H01F 27/306; H01F 27/40; H01F 27/2866; H01F 27/24; H01F 27/28; H01F 27/38

See application file for complete search history.

(56) References Cited

U.S. PATENT DOCUMENTS 2,513,512 A * 7/1950 Olthof ..... H01F 38/085 323/347

2004/0070480 A1* 4/2004 Nakashima ..... H01F 27/327 336/200

* cited by examiner

*Primary Examiner* — Tuyen T Nguyen

(74) *Attorney, Agent, or Firm* — Muncy, Geissler, Olds & Lowe, P.C.

(57) ABSTRACT

A magnetic component module includes a magnetic core group, a first winding, a second winding, and a third winding. The magnetic core group includes a first magnetic core, a second magnetic core disposed corresponding to the first magnetic core, and a third magnetic core disposed corresponding to the second magnetic core. The second magnetic core is placed between the first magnetic core and the third magnetic core. The first winding and the second winding are placed between the first magnetic core and the second magnetic core. The third winding is placed in the third magnetic core. The first magnetic core, the second magnetic core, the first winding, and the second winding together constitute a transformer. The third magnetic core and the third winding constitute an inductive component. Therefore, less components are used, manufacturing is simplified, and production costs are reduced.

7 Claims, 13 Drawing Sheets

MAGNETIC COMPONENT MODULE

TECHNICAL FIELD

The present disclosure relates to a transformer technique and, in particular, to a magnetic component module.

BACKGROUND

A transformer is a device that transforms high-voltage low-stability input AC power into low-voltage high-stability output DC power for use in various electronic devices. Transformers are extensively used in computers, office automation equipment, industrial control equipment, communication equipment, and other electronic devices. An inductive component can suppress electromagnetic interferences in circuits or prevent noise signals caused by electromagnetic interferences. The inductive component is commonly used in electronic equipment, power supplies, electronic devices, power equipment, and high frequency equipment.

Two different production lines are used to manufacture the transformer and the inductive component separately, and then the transformer and the inductive component are electrically connected by means of copper foil circuits of a printed circuit board.

However, there are problems with manufacturing the transformer and the inductive component. Since they are manufactured using two different production lines, labor costs are considerable. Moreover, manufacturing tolerances for the two different production lines should also be calculated separately, so more space is taken up, and power density is therefore not high. Electrical connection is achieved through the copper foil circuit, and the copper foil on the circuit board has a small thickness and high impedance, thus causing a large power loss to the whole structure. In addition to that, installation of the transformer and the inductive component needs a large space on the main circuit board, utilization of space on the main circuit board therefore cannot be improved efficiently, and consequently it is hard to satisfy the increasing demand of smaller and more efficient electronic equipment. Furthermore, the transformer and the inductive component do not have a magnetic core group for shared use, so costs for components are not decreased, which is a problem that should be overcome.

SUMMARY

It is an objective of the present disclosure to provide a magnetic component module which simplifies manufacturing, uses less components and significantly reduces production costs by means of configurations of components.

Accordingly, the present disclosure provides a magnetic component module. The magnetic component module includes a magnetic core group, a first winding, a second winding, and a third winding. The magnetic core group includes a first magnetic core, a second magnetic core disposed corresponding to the first magnetic core, and a third magnetic core disposed corresponding to the second magnetic core. The second magnetic core is disposed between the first magnetic core and the third magnetic core. The first winding is disposed between the first magnetic core and the second magnetic core. The second winding is disposed between the first magnetic core and the second magnetic core. The third winding is disposed on the third magnetic core. The first magnetic core, the second magnetic core, the first winding, and the second winding constitute a transformer. The third magnetic core and the third winding constitute an inductive component. The second winding includes a plurality of coil groups. The third winding includes a coil group. The coil group of the third winding is extended from an outgoing end of the second winding and integrally formed therewith.

Accordingly, a magnetic component module is provided according to another embodiment of the present disclosure. The magnetic component module includes a magnetic core group, a first winding, a second winding, and a third winding. The magnetic core group includes a first magnetic core and a second magnetic core disposed corresponding to the first magnetic core. The first winding is disposed on the first magnetic core. The second winding is disposed on the first magnetic core. The third winding is disposed on the second magnetic core. The first magnetic core, the first winding and the second winding constitute a transformer. The second magnetic core and the third winding constitute an inductive component. The second winding includes a plurality of coil groups. The third winding includes a coil group. The coil group of the third winding is extended from an outgoing end of the second winding and is integrally formed therewith.

The present disclosure has advantages like saving space and minimizing power losses resulting from a longer wire length. By using the shared-use magnetic core, less components are needed, and component costs are thereby reduced. During manufacturing, only the manufacturing tolerances for one module need to be calculated as manufacturing tolerances for one component are omitted. As a result, power density is improved.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
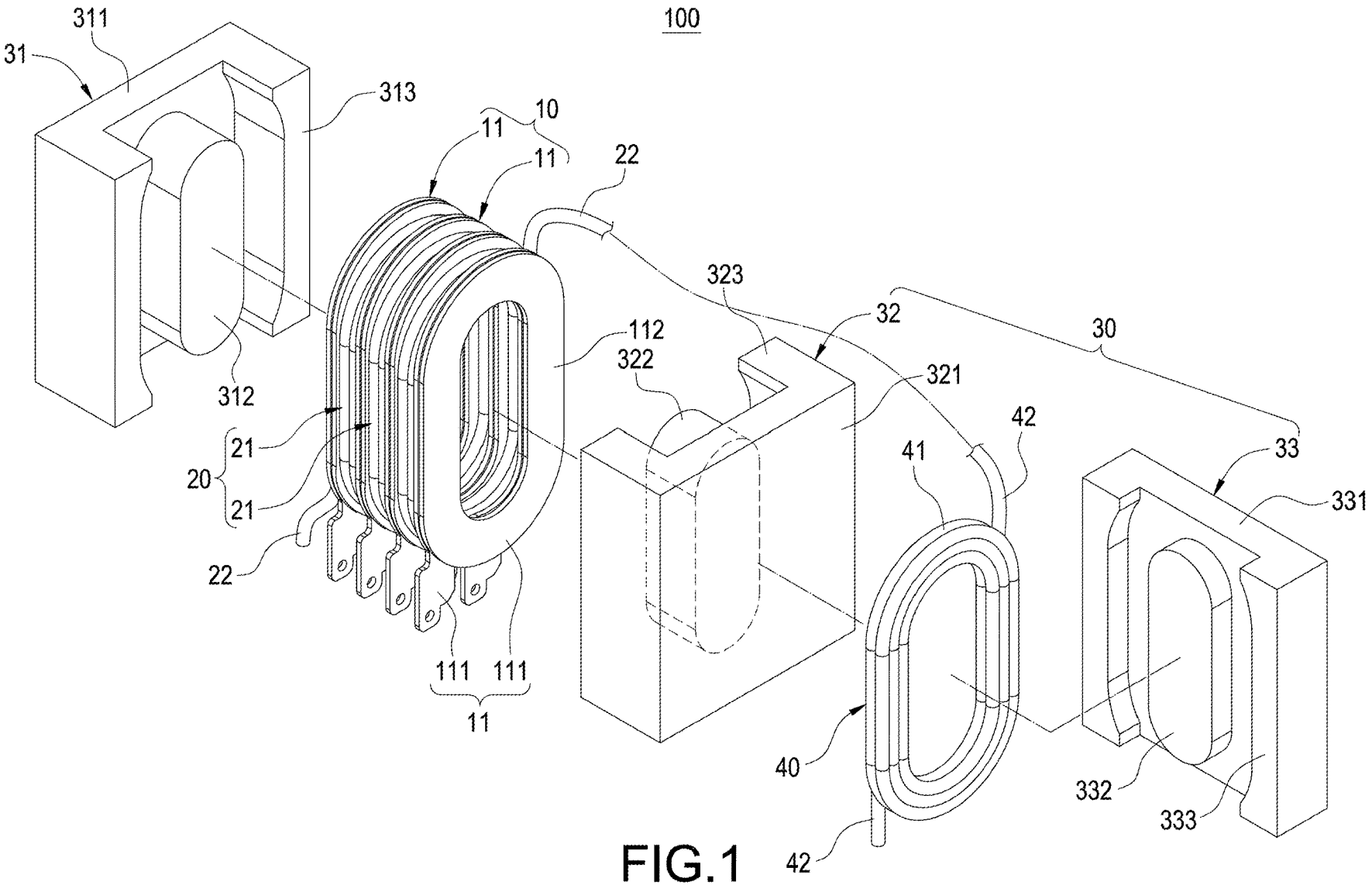
FIG. 1 is a perspective exploded view illustrating a magnetic component module according to the first embodiment of the present disclosure.
Figure 2:
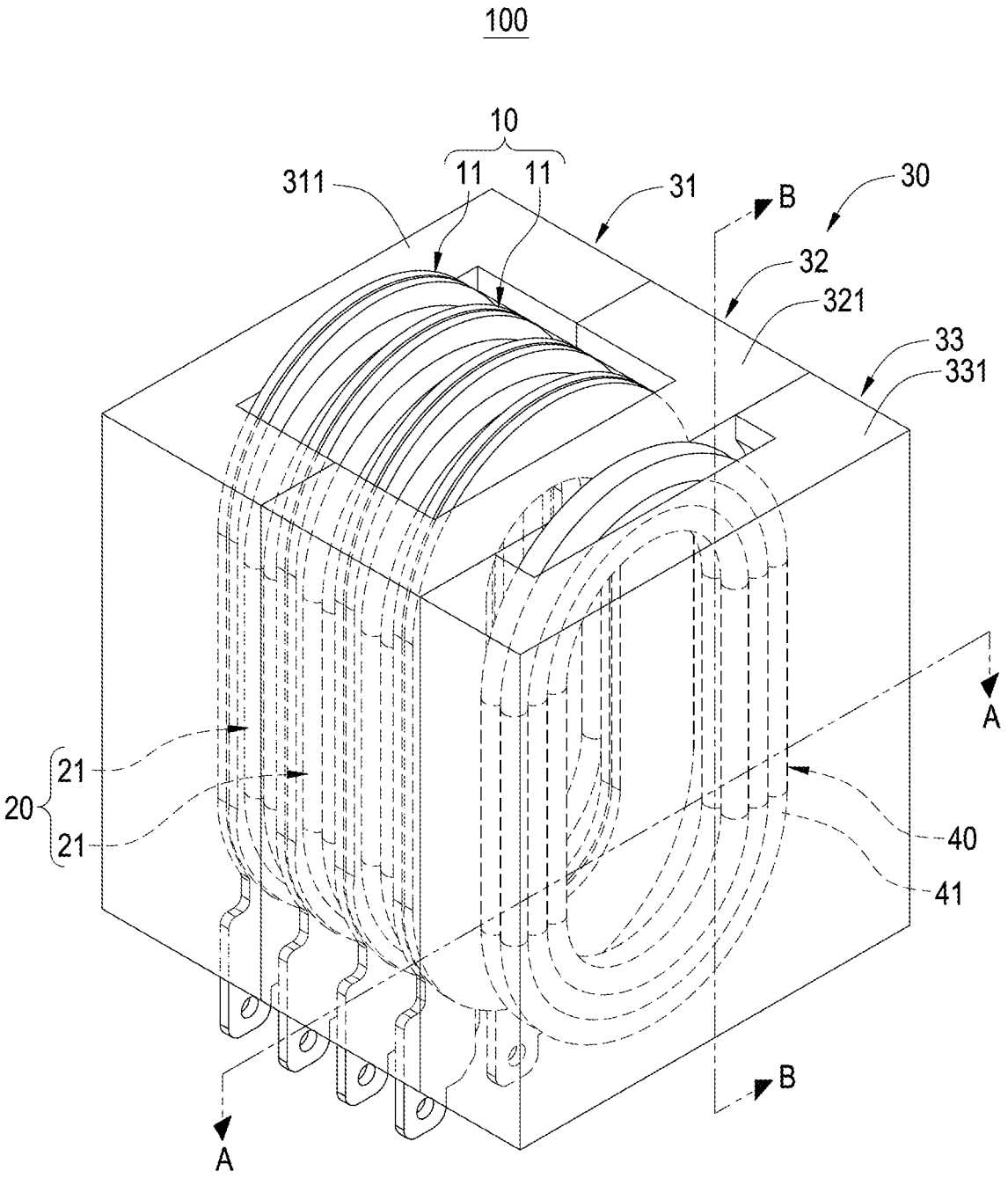
FIG. 2 is an assembled view illustrating the magnetic component module according to the first embodiment of the present disclosure.
Figure 3:
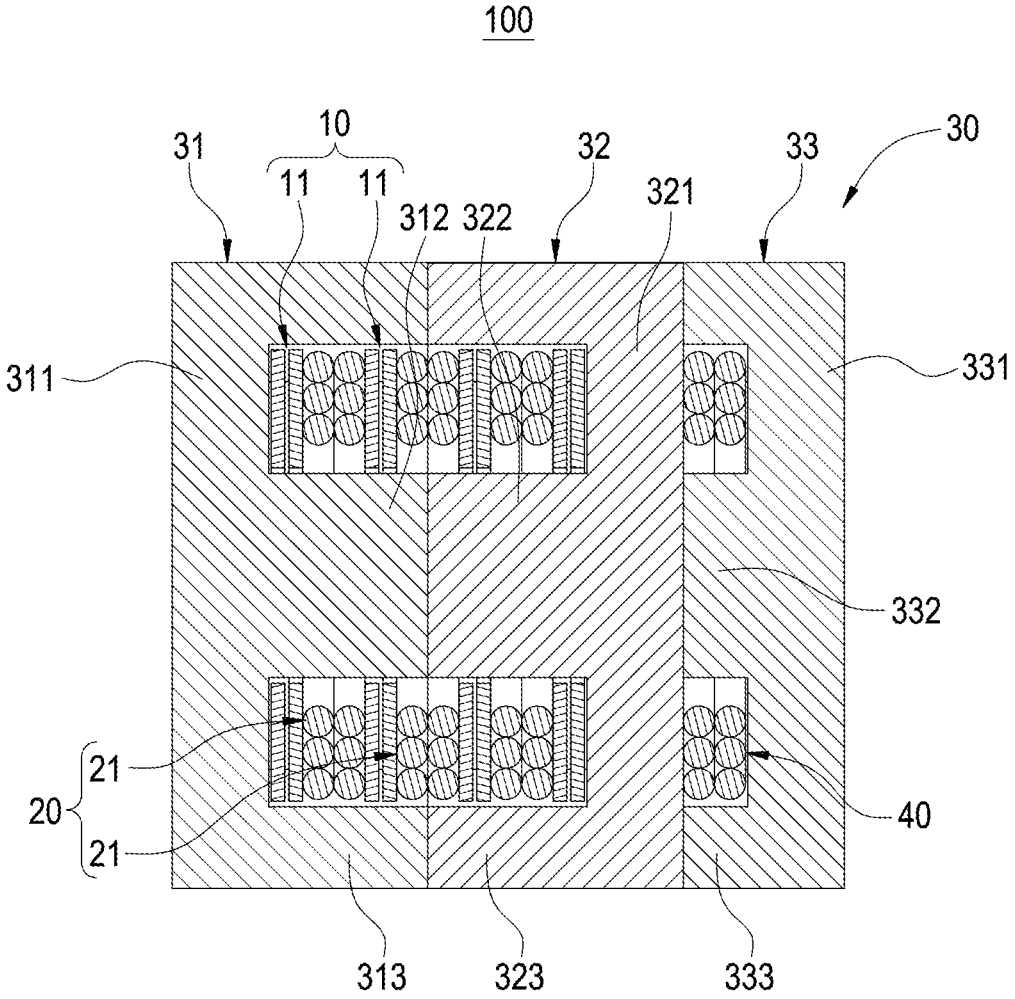
FIG. 3 is a cross-sectional view, taken from line A-A in FIG. 2, illustrating the magnetic component module.
Figure 4:
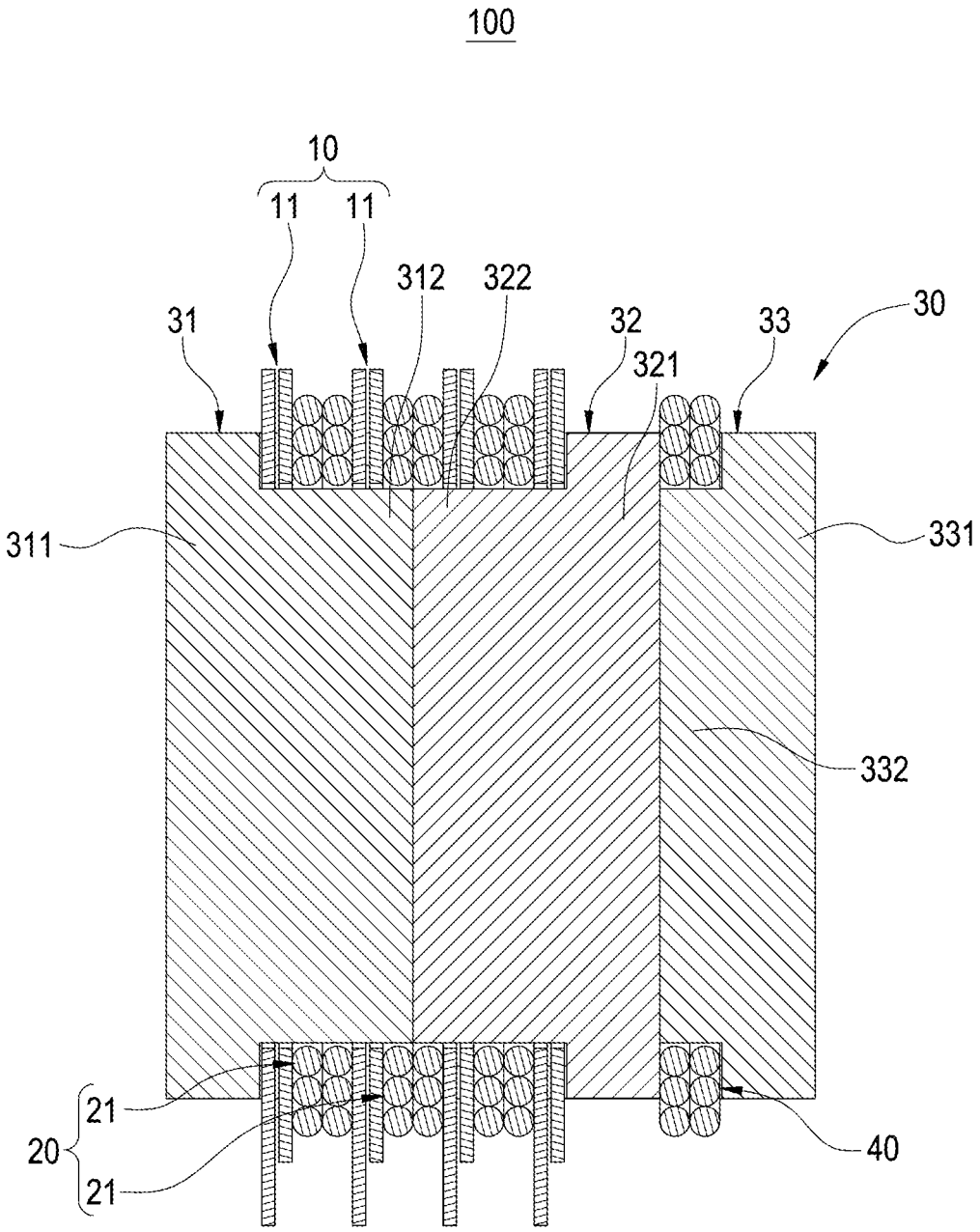
FIG. 4 is a cross-sectional view, taken from line B-B in FIG. 2, illustrating the magnetic component module.

Detailed descriptions and technical contents of the present disclosure are illustrated below in conjunction with the accompanying drawings. However, it is to be understood that the descriptions and the accompanying drawings disclosed herein are merely illustrative and exemplary and not intended to limit the scope of the present disclosure.

Please refer to FIGS. 1 to 4 illustrating a magnetic component module 100 according to the first embodiment of the present disclosure. The magnetic component module 100 of the present embodiment includes a first winding 10, a second winding 20, a magnetic core group 30, and a third winding 41.

The first winding 10 comprises a plurality of conductive units 11. The conductive units 11 are arranged spaced apart from each other. Each conductive unit 11 is a double-layered copper plate. In other words, each conductive unit 11 includes two copper plates 111. The copper plate 111 consists of copper or alloy thereof. An insulating sheet (not illustrated) can be disposed between the two copper plates 111 of each conductive unit 11, so there is a small gap between the copper plates 111. The copper plate 111 of each conductive unit 11 is electrically connected to the same-direction copper plate 111 of the adjacent conductive unit 11 through a conductor or a wire (not illustrated).

The second winding 20 includes a plurality of coil groups 21. Each coil group 21 is interposed between each two adjacent conductive units 11 of the first winding 10 respectively. The coil group 21 can be an enameled wire, which consists of a wire coated with a layer of insulation. The second winding 20 is made by using a continuous winding machine to perform continuous winding operations. In other words, the coil groups 21 are electrically connected. The first-loop coil group 21 and the last-loop coil group 21 each have an outgoing end 22 at their respective end portions. In alternative embodiments, the coil group 21 consists of a three-layered insulating wire.

In the present embodiment, the magnetic core group 30 includes a first magnetic core 31, a second magnetic core 32 and a third magnetic core 33. The second magnetic core 32 is disposed between the first magnetic core 31 and the third magnetic core 33. The first magnetic core 31 has an E-shaped cross-section. The first magnetic core 31 includes a flat plate 311, a central pillar 312 extended from a central position of the flat plate 311, and two side pillars 313 extended from two end edges of the flat plate 311. The two side pillars 313 are disposed at two sides of the central pillar 312. In the present embodiment, the central pillar 312 has an elliptical-like-shaped cross-section; however, the central pillar 312 can be of other shape, and the present disclosure is not limited in this regard. Similarly, the second magnetic core 32 and the third magnetic core 33 also have the same structure and structure details as the first magnetic core 31. In other words, the second magnetic core 32 includes a flat plate 321, a central pillar 322 and two side pillars 323. The third magnetic core 33 also includes a flat plate 331, a central pillar 332 and two side pillars 333.

The second magnetic core 32 is assembled to the first magnetic core 31. The central pillar 322 of the second magnetic core 32 is disposed corresponding to the central pillar 312 of the first magnetic core 31. The two side pillars 323 of the second magnetic core 32 are disposed corresponding to the two side pillars 313 of the first magnetic core 31. The conductive units 11 and the coil groups 21 are disposed between the first magnetic core 31 and the second magnetic core 32. In other words, the central pillars 312, 322 are inserted through respective central positions of the conductive units 11 and the coil groups 21. The side pillars 313, 323 cover at two sides of the conductive units 11 and the coil groups 21.

The first magnetic core 31, the second magnetic core 32, the first winding 10 and the second winding 20 together constitute a transformer. The third magnetic core 33 and the third winding 41 together constitute an inductive component 40. The third winding 41 includes a coil group. The coil group of the third winding 41 is extended from an outgoing end 22 of the coil groups 21 of the second winding 20 and integrally formed therewith. In other words, an outgoing end 42 of the third winding 41 is one-piece formed with the outgoing end 22 of the second winding 20 to thereby reduce the loss caused by a wire length. In addition to that, a wire diameter of the coil group of the third winding 41 is equal to a wire diameter of each coil group 21 of the second winding 20. That is to say, the second winding 20 and the third winding 41 are electrically connected to each other. As a result, the continuous winding machine can be used to wind the wire into coils of a certain loop number and a desired layer number to constitute the coil group of the third winding 41 and the coil groups 21 of the second winding 20. Therefore, there is no need for using two production lines, only one production line is needed, and thus manual labor of one production line can be saved. In alternative embodiments, the coil group of the third winding 41 and the coil groups 21 of the second winding 20 can also be made separately, and an outgoing end 42 is formed at each end of the third winding 41. In the present embodiment, the coil group of the third winding 41 and the coil groups 21 of the second winding 20 are of the same shape. However, in alternative embodiments, the coil group of the third winding 41 and the coil groups 21 of the second winding 20 can be of different shapes.

The third magnetic core 33 is assembled to the second magnetic core 32, and the central pillar 332 of the third magnetic core 33 is disposed corresponding to a central position of the flat plate 321 of the second magnetic core 32. The side pillars 333 of the third magnetic core 33 are disposed corresponding to two end edges of the flat plate 321 of the second magnetic core 32. The third winding 41 is wound around the central pillar 332 of the third magnetic core 33. In other words, the central pillar 332 is inserted through a central position of the third winding 41, and the side pillars 333 of the third magnetic core 33 cover two sides of the third winding 41.

The first magnetic core 31, the second magnetic core 32, the first winding 10 and the second winding 20 constitute the transformer, the third magnetic core 33 and the third winding 41 constitute the inductive component 40, and as a result, it only takes three magnetic cores to form a magnetic component module. So, when a designer makes a circuit layout design for a circuit board, only the manufacturing tolerances for one module need to be calculated as manufacturing tolerances for one component are omitted. Therefore, more space is saved. As a result, power density is improved.

Figure 5:
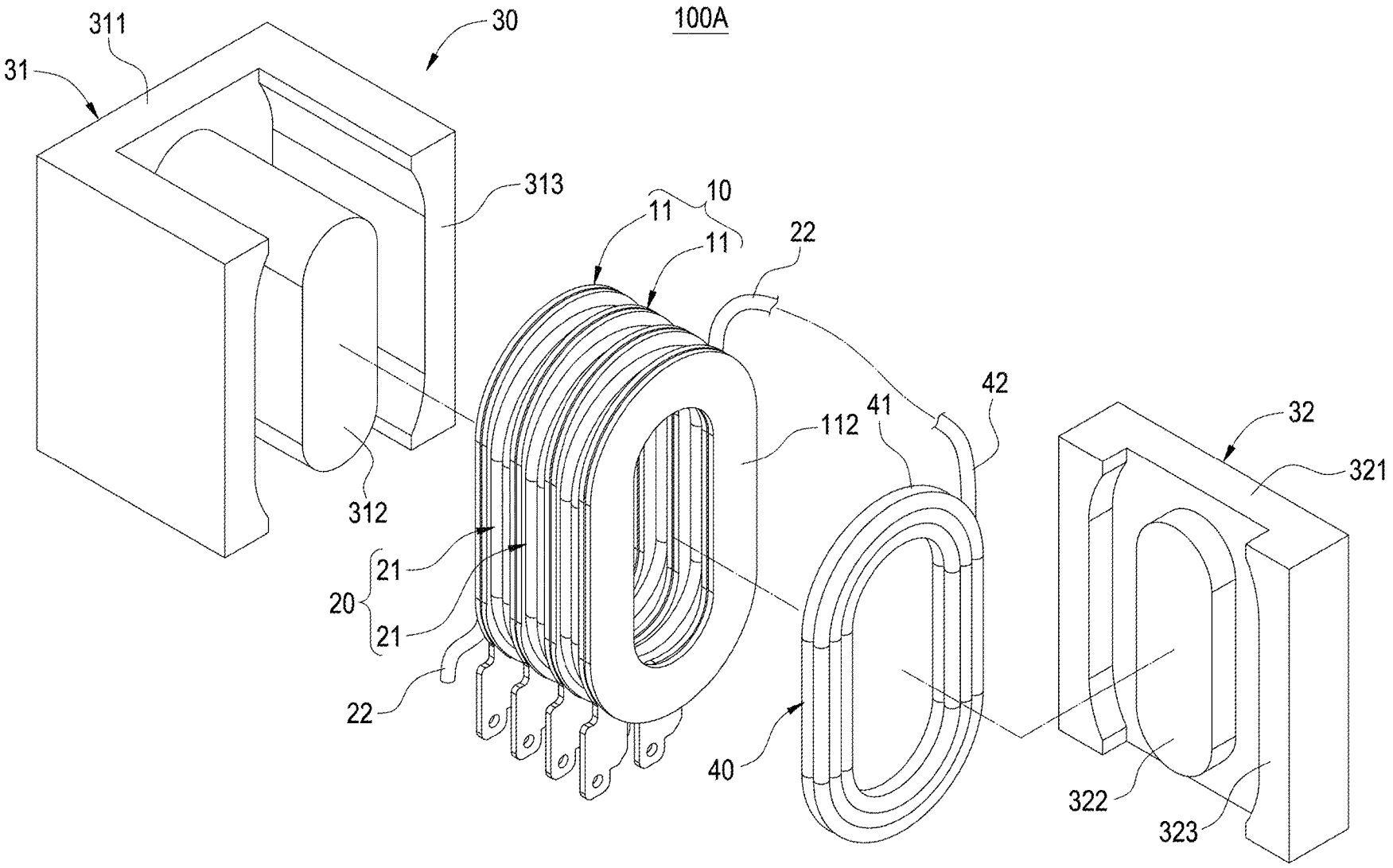
FIG. 5 is a perspective exploded view illustrating the magnetic component module according to the second embodiment of the present disclosure.
Figure 6:
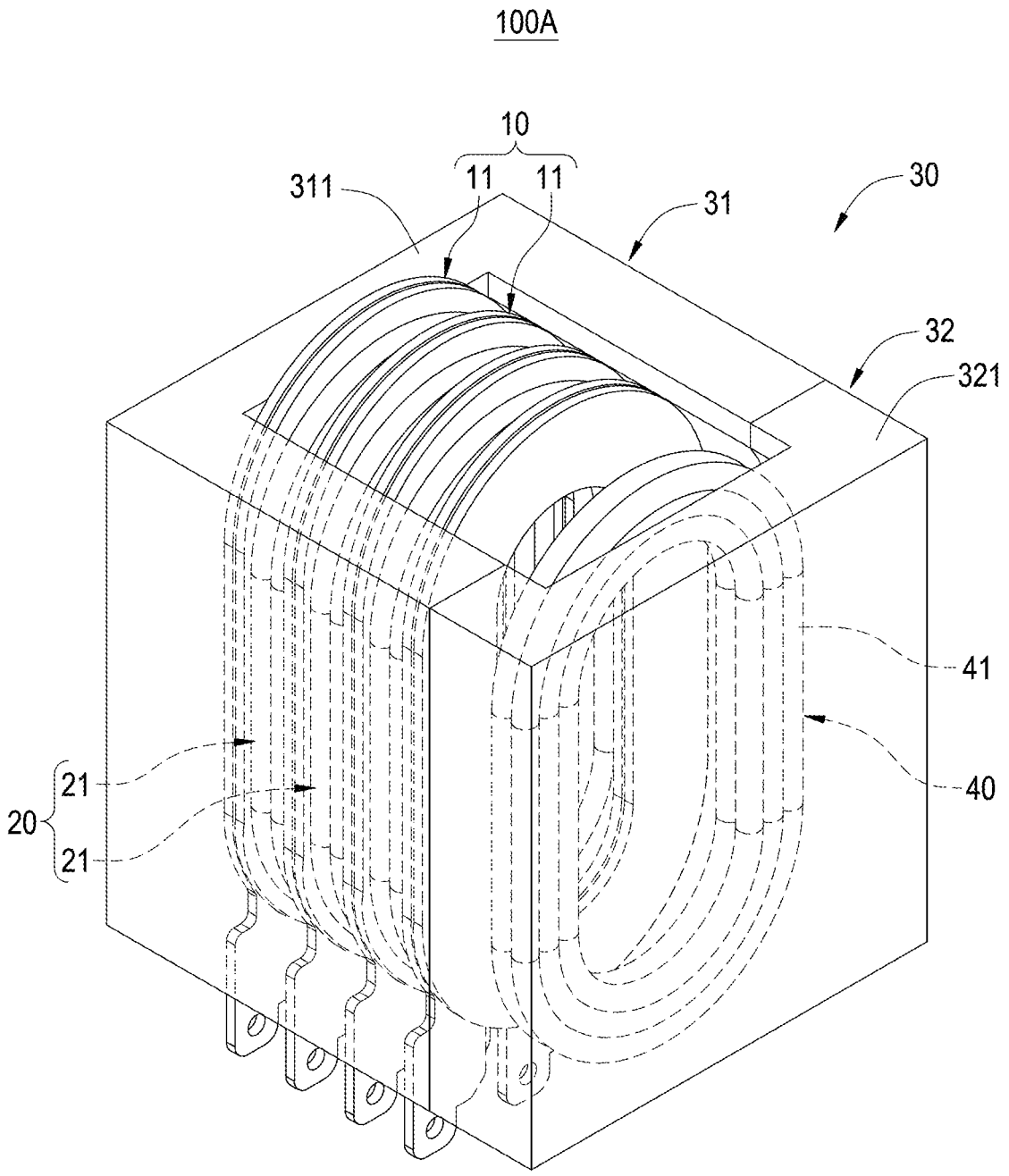
FIG. 6 is an assembled view illustrating the magnetic component module according to the second embodiment of the present disclosure.
Figure 7:
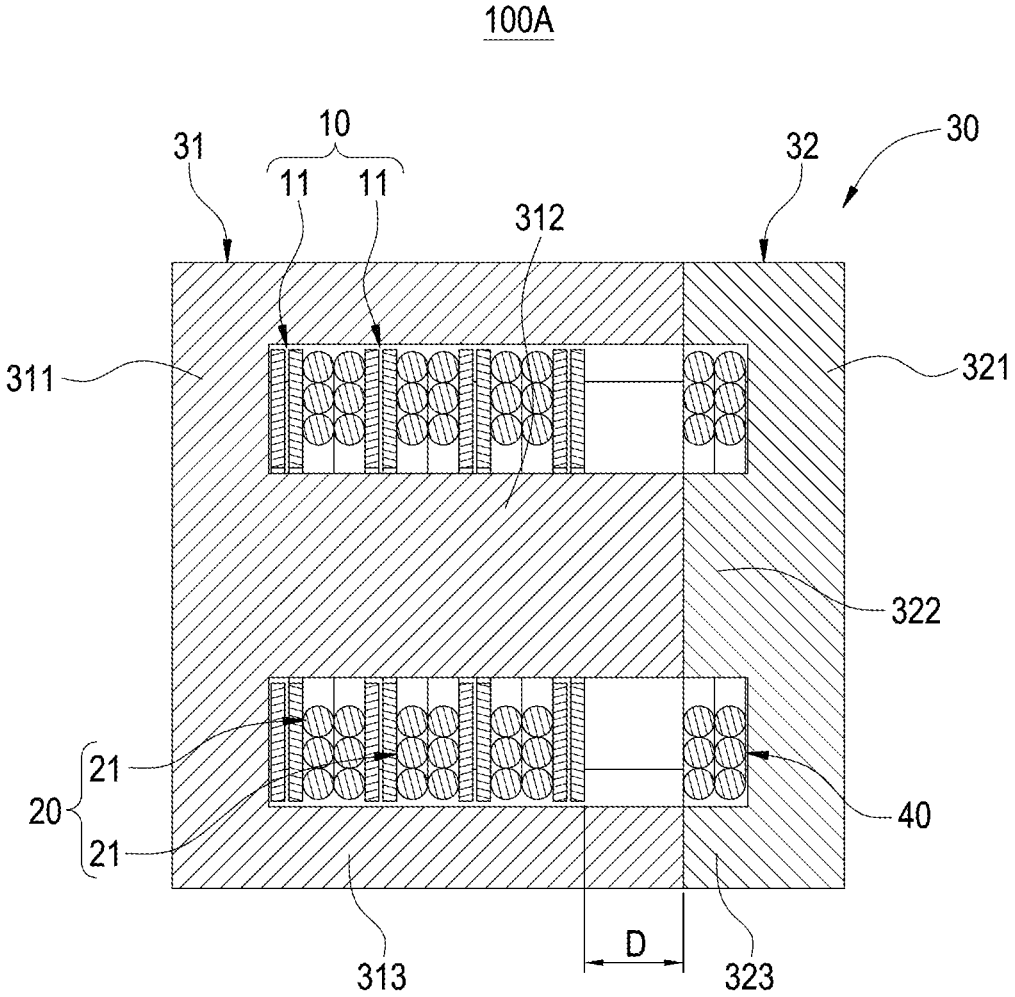
FIG. 7 is a cross-sectional view illustrating the magnetic component module according to the second embodiment of the present disclosure.

Referring to FIGS. 5 to 7, the magnetic component module 100A includes a first winding 10, a second winding 20, a magnetic core group 30 and a third winding 41. The magnetic core group 30 includes a first magnetic core 31 and a second magnetic core 32 disposed corresponding to the first magnetic core 31. The first winding 10 and the second winding 20 are disposed on a central pillar 312 of the first magnetic core 31. The third winding 41 is disposed on a central pillar 322 of the second magnetic core 32. The first magnetic core 32, the first winding 10 and the second winding 20 constitute a transformer. The second magnetic core 32 and the third winding 41 constitute an inductive component 40.

The first winding 10, the second winding 20 and the third winding 41 in the present embodiment are the same as those in the previous embodiment. The first magnetic core 31 and the second magnetic core 32 in the magnetic core group 30 in the present embodiment have structures similar to those of the first magnetic core 31 and the second magnetic core 32 in the previous embodiment. The third winding 41 of the inductive component 40 is extended from and integrally formed with an outgoing end 22 of the last-loop coil group 21. In other words, an outgoing end 42 of the third winding 41 is one-piece formed with the outgoing end 22 of the second winding 20. Moreover, the third winding 41 is located a distance D away from the conductive unit 11 closest to the second magnetic core 32 to thereby reduce leakage inductance (i.e. increasing a leakage inductance value). The central pillar 322 of the second magnetic core 32 is inserted through the central position of the third winding 41. The two side pillars 323 of the second magnetic core 32 cover two sides of the third winding 41.

Figure 8:
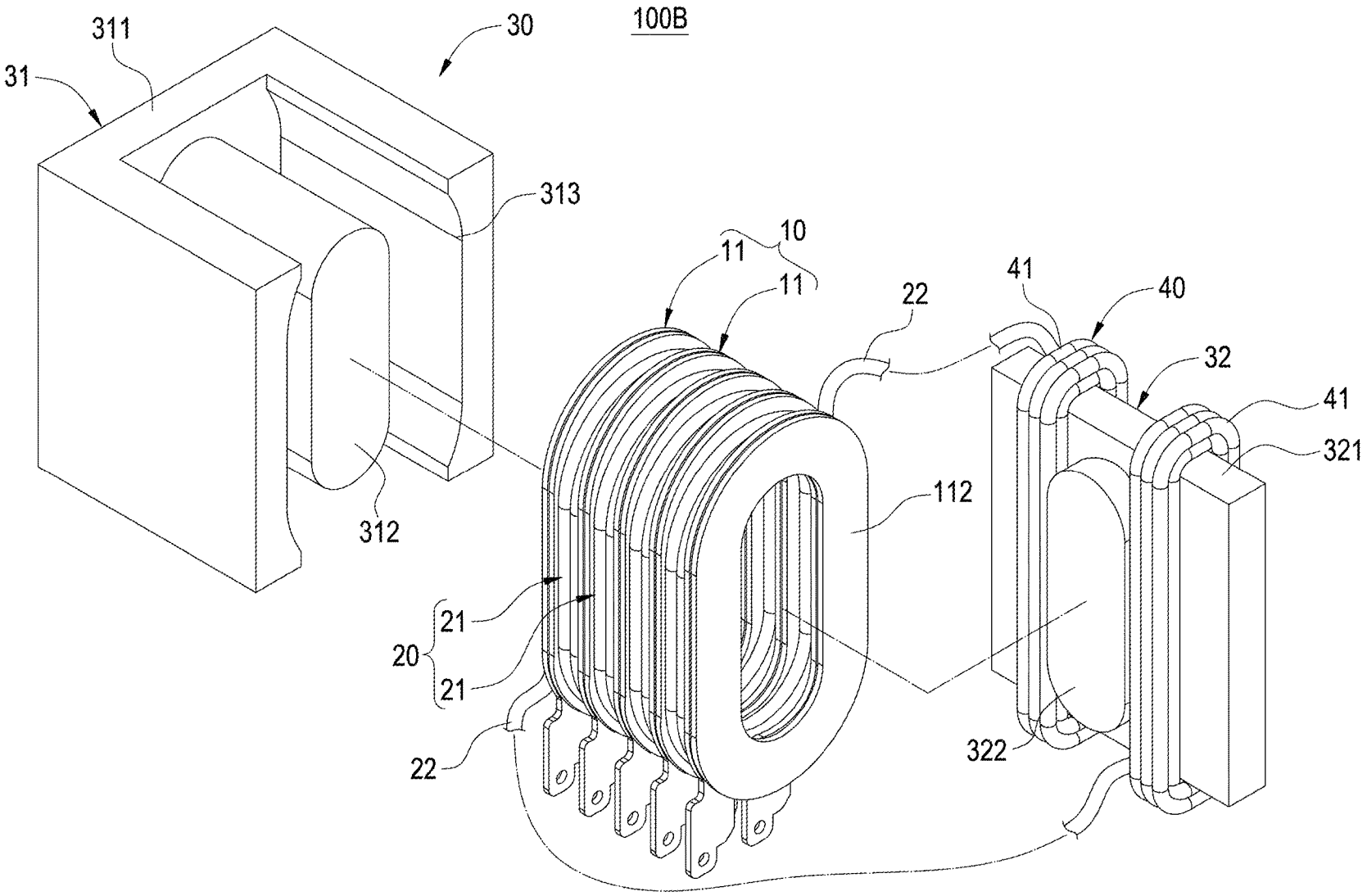
FIG. 8 is a perspective exploded view illustrating the magnetic component module according to the third embodiment of the present disclosure.
Figure 9:
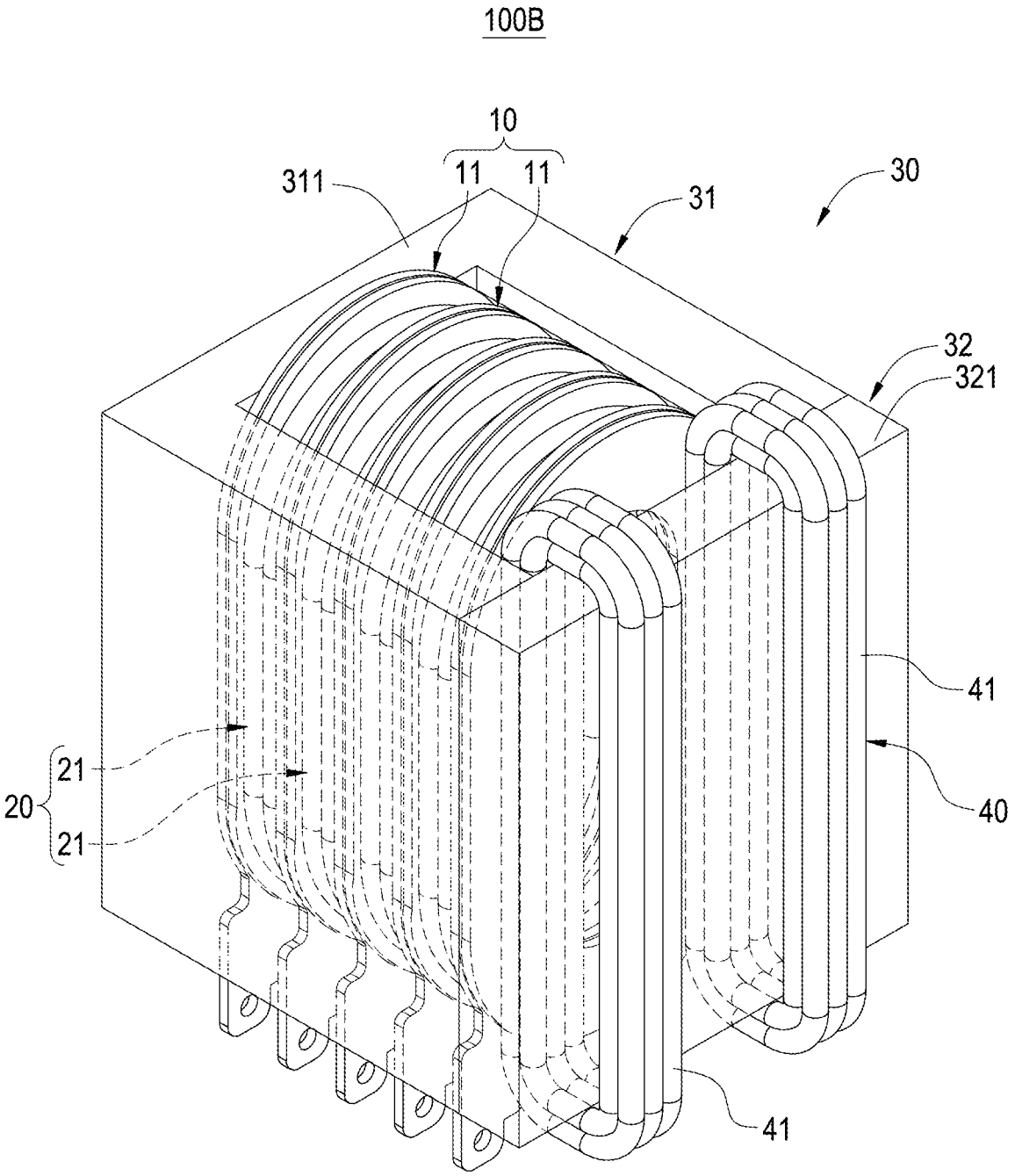
FIG. 9 is an assembled view illustrating the magnetic component module according to the third embodiment of the present disclosure.
Figure 10:
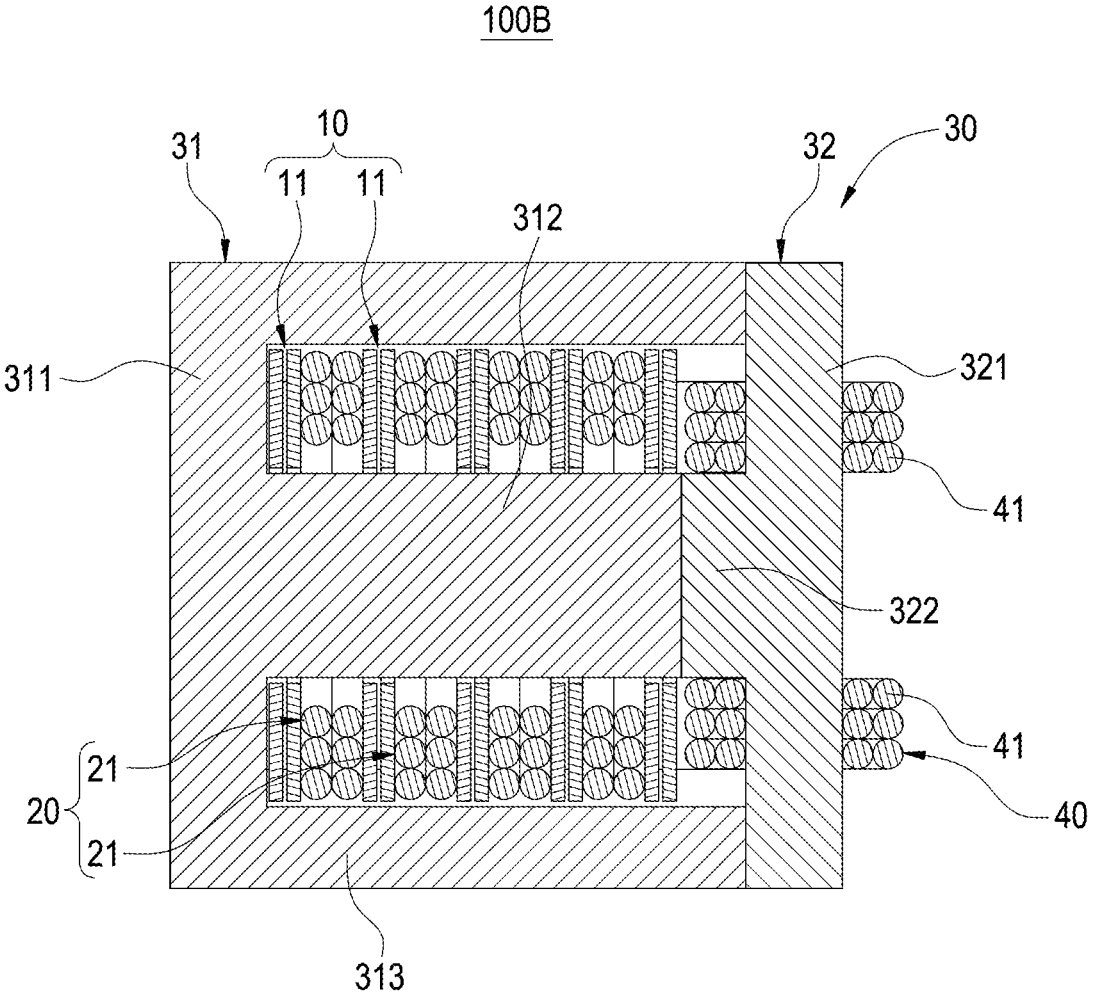
FIG. 10 is a cross-sectional view illustrating the magnetic component module according to the third embodiment of the present disclosure.

Referring to FIGS. 8 to 10, the magnetic component module 100B also includes a first winding 10, a second winding 20, a magnetic core group 30 and a third winding 41. The magnetic core group 30 includes a first magnetic core 31 and a second magnetic core 32 disposed corresponding to the first magnetic core 31. The first winding 10 is disposed on the first magnetic core 31. The first winding 10 and the second winding 20 are disposed on a central pillar 312 of the first magnetic core 31. The third winding 41 is disposed at two sides of the central pillar 322 of the second magnetic core 32. The first magnetic core 31, the first winding 10 and the second winding 20 constitute a transformer. The second magnetic core 32 and the third winding 41 constitute an inductive component 40.

In detail, the second magnetic core 32 in the present embodiment has a T-shaped cross-section. The second magnetic core 32 has a flat plate 321 and a central pillar 322. The central pillar 312 of the first magnetic core 31 is inserted through respective central positions of the conductive units 11 and the coil groups 21 and is disposed corresponding to the central pillar 322 of the second magnetic core 32. The two side pillars 313 of the first magnetic core 31 cover at two sides of the conductive units 11 and the coil groups 21 and are disposed corresponding to two end edges of the second magnetic core 32. The third winding 41 of the inductive component 40 is directly extended from the coil group 21 and is integrally formed therewith. Alternatively, the third winding 41 and the coil group 21 can be manufactured separately. Two third windings 41 are wound around the flat plate 321 and formed at two sides of the central pillar 322.

Figure 11:
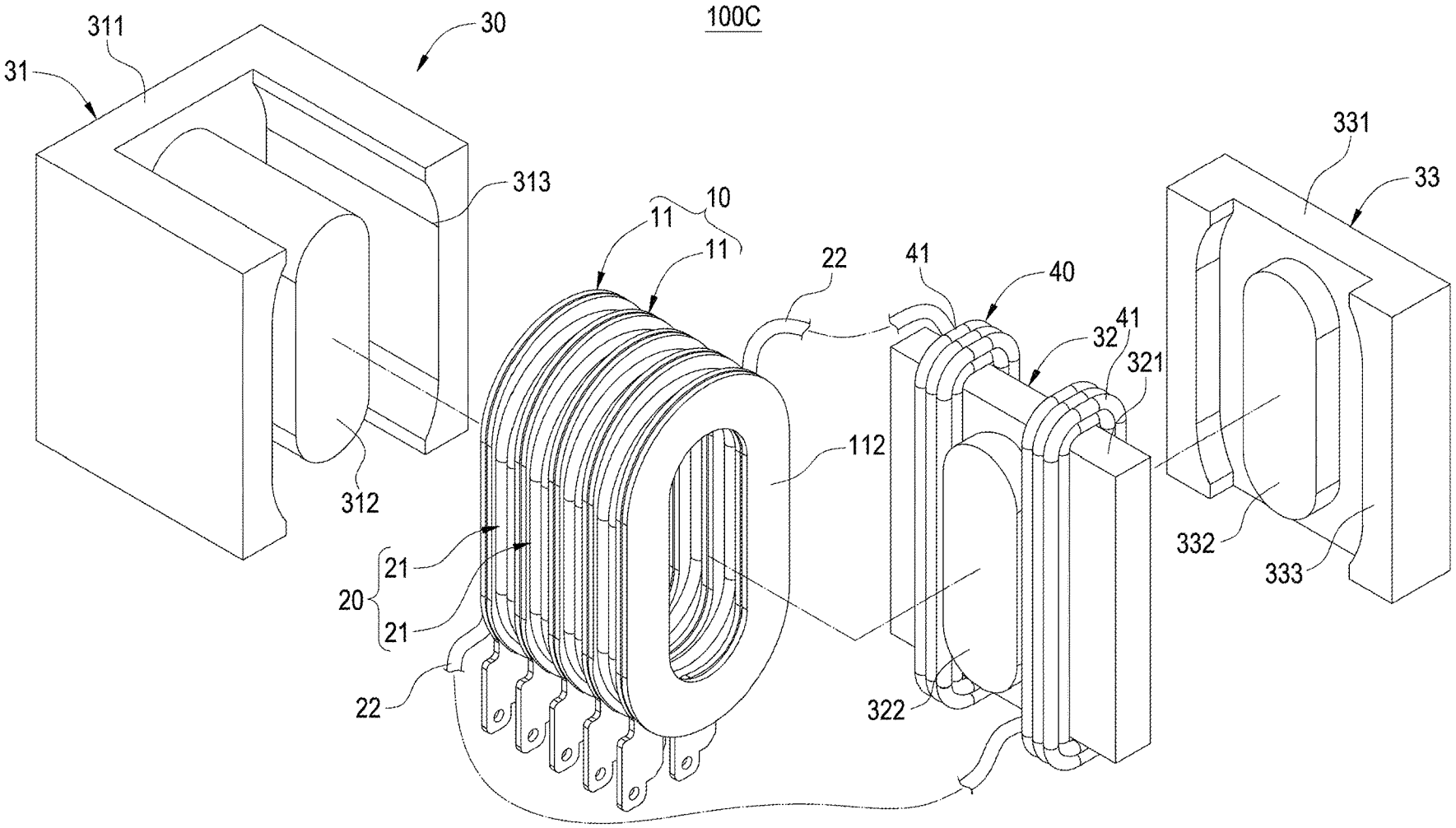
FIG. 11 is a perspective exploded view illustrating the magnetic component module according to the fourth embodiment of the present disclosure.
Figure 12:
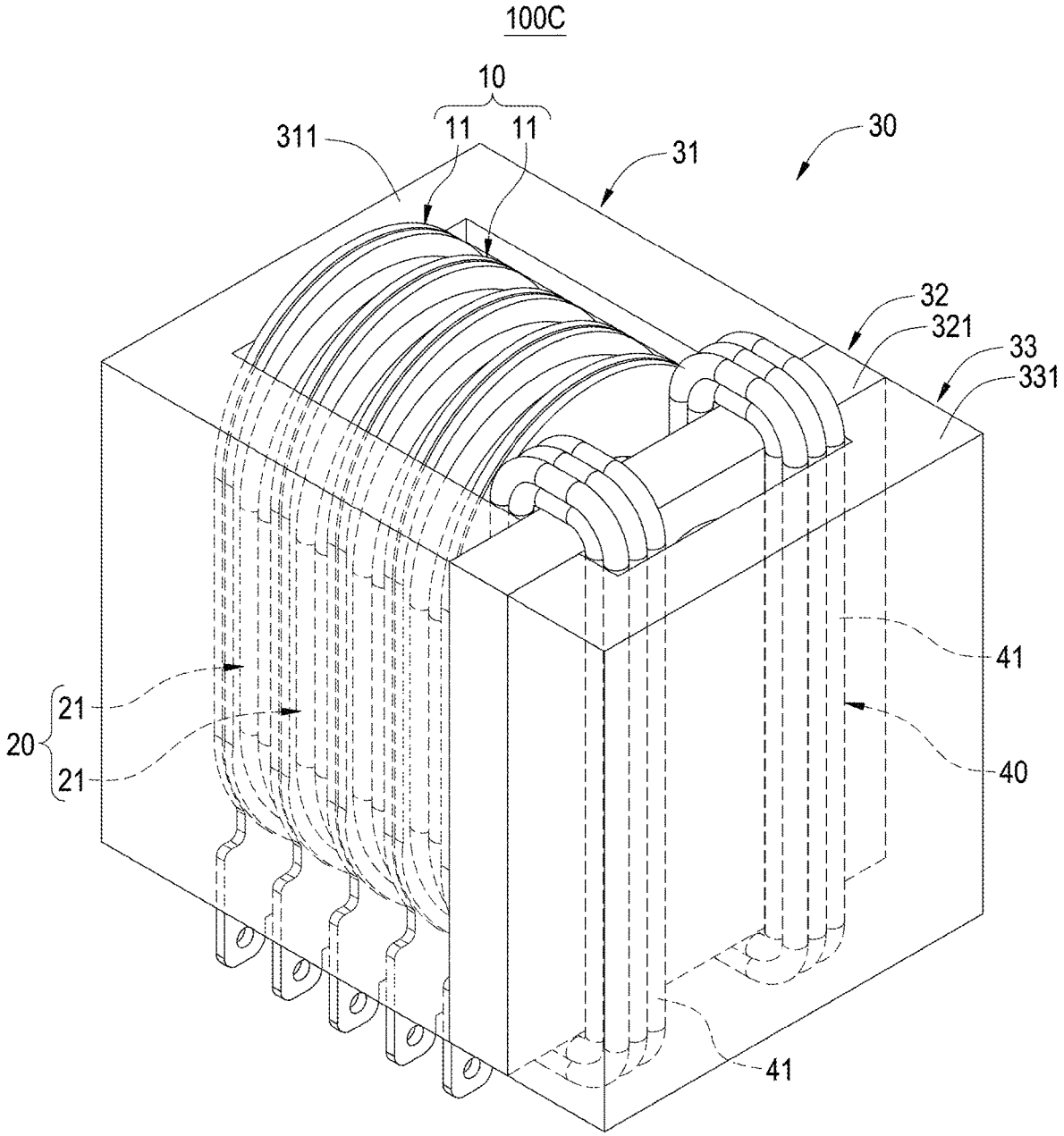
FIG. 12 is an assembled view illustrating the magnetic component module according to the fourth embodiment of the present disclosure.
Figure 13:
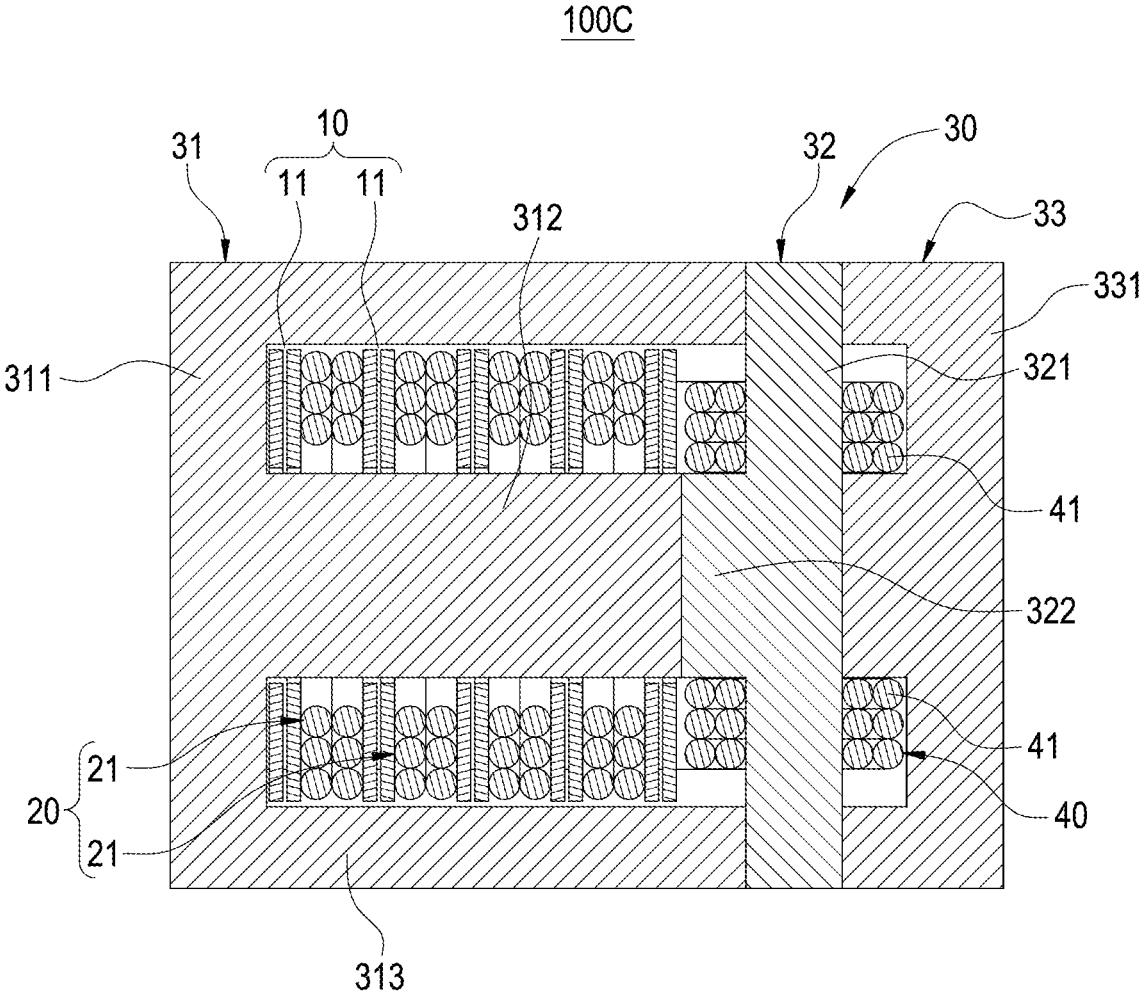
FIG. 13 is an assembled cross-sectional view illustrating the magnetic component module according to the fourth embodiment of the present disclosure.

Please refer to FIGS. 11 to 13, illustrating the magnetic component module 100C according to the fourth embodiment of the present disclosure. The magnetic component module 100C of the fourth embodiment is similar to the magnetic component module 100B of the third embodiment. However, the fourth embodiment further includes a third magnetic core 33. The third magnetic core 33 is assembled to the second magnetic core 32. In other words, the central pillar 332 of the third magnetic core 33 is disposed corresponding to the central position of the flat plate 321 of the second magnetic core 32. The two side pillars 333 of the third magnetic core 33 are disposed corresponding to the two end edges of the flat plate 321 of the second magnetic core 32. The flat plate 331 and the two side pillars 333 of the third magnetic core 33 together cover the third winding 41 to increase the leakage inductance value and control other values as needed.

In addition, the drawings in the foregoing embodiments are for illustrative purposes only. In practice, in the foregoing embodiments, there are air gaps between the central pillars and between the central pillar and flat plate. Furthermore, no bobbins are used in these embodiments in order to save space. However, in alternative embodiments, the winding can be disposed on the bobbin to facilitate assembling.

In summary, the magnetic component module of the present disclosure can certainly achieve the anticipated objects and solve the problems of conventional techniques, and has novelty and non-obviousness, so the present disclosure completely meets the requirements of patentability. Therefore, a request to patent the present disclosure is filed according to patent laws. Examination is kindly requested, and allowance of the present disclosure is solicited to protect the rights of the inventor.

What is claimed is:

1. A magnetic component module, comprising:

a magnetic core group including a first magnetic core and a second magnetic core disposed corresponding to the first magnetic core;

a first winding disposed on the first magnetic core;

a second winding disposed on the first magnetic core; and a third winding disposed on the second magnetic core, wherein the first magnetic core, the first winding and the second winding constitute a transformer, the second magnetic core and the third winding constitute an inductive component, wherein the second winding includes a plurality of coil groups, the third winding includes a coil group, the coil group of the third winding is extended from an outgoing end of the second winding and is integrally formed therewith, wherein the first magnetic core includes a flat plate, a central pillar extended from a central position of the flat plate, and two side pillars extended from two end edges of the flat plate, the second magnetic core includes a flat plate and a central pillar, the central pillar of the first magnetic core is inserted through a central position of the first winding and a central position of the second winding and is disposed corresponding to the central pillar of the second magnetic core, and the two side pillars of the first magnetic core cover two sides of the first winding and the second winding and are disposed corresponding to two end edges of the flat plate of the second magnetic core, wherein the third winding is wound on the flat plate of the second magnetic core and is disposed at two sides of the central pillar of the second magnetic core.

2. The magnetic component module according to claim 1, wherein the first winding comprises a plurality of conductive units.

3. The magnetic component module according to claim 2, wherein the conductive unit is a plurality of copper plates.

4. The magnetic component module according to claim 1, wherein the magnetic core group includes a third magnetic core, and the third magnetic core is assembled to the second magnetic core.

5. The magnetic component module according to claim 4, wherein the third magnetic core includes a flat plate and a central pillar, and the central pillar of the third magnetic core is disposed corresponding to the second magnetic core.

6. The magnetic component module according to claim 5, wherein the third magnetic core further includes two side pillars, the flat plate and the two side pillars of the third magnetic core together cover the third winding.

7. A magnetic component module, comprising:

a magnetic core group including a first magnetic core and a second magnetic core disposed corresponding to the first magnetic core;

a first winding disposed on the first magnetic core;

a second winding disposed on the first magnetic core; and a third winding disposed on the second magnetic core, wherein the first magnetic core, the first winding and the second winding constitute a transformer, the second magnetic core and the third winding constitute an inductive component, wherein the second winding includes a plurality of coil groups, the third winding includes a coil group, the coil group of the third winding is extended from an outgoing end of the second winding and is integrally formed therewith.

wherein a wire diameter of the coil group of the third winding is equal to a wire diameter of each coil group of the second winding.

* * * * *